US006227746B1

(12) United States Patent
Long et al.

(10) Patent No.: US 6,227,746 B1
(45) Date of Patent: May 8, 2001

(54) HANGING DATA BINDER

(75) Inventors: Robert J. Long, Lake-In-The Hills; Jeffrey S. Lippeth, Grays Lake, both of IL (US)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

(21) Appl. No.: 09/143,448

(22) Filed: Aug. 28, 1998

Related U.S. Application Data

(60) Provisional application No. 60/056,256, filed on Aug. 19, 1997.

(51) Int. Cl.[7] ..... B42F 13/40

(52) U.S. Cl. ..... 402/4; 211/46; 312/184; 402/17

(58) Field of Search ..... 402/4, 17; 211/46; 312/184

(56) References Cited

U.S. PATENT DOCUMENTS

| | | | | |
|---|---|---|---|---|
| D. 240,395 | | 7/1976 | Feldmahr . | |
| 1,548,248 | | 8/1925 | Binns et al. . | |
| 1,562,320 | | 11/1925 | Farley . | |
| 3,790,242 | | 2/1974 | Sullivan | 312/184 |
| 3,865,445 | | 2/1975 | Dean et al. | 312/184 |
| 3,957,321 | | 5/1976 | Rose | 312/184 |
| 4,288,170 | | 9/1981 | Barber | 402/17 |
| 4,327,952 | * | 5/1982 | Cournoyer et al. | 312/184 |
| 4,403,882 | * | 9/1983 | Fleck | 402/4 |
| 4,445,799 | | 5/1984 | Wright et al. | 402/4 |
| 4,674,637 | | 6/1987 | Lovelock et al. | 211/46 |
| 4,820,073 | * | 4/1989 | Thomas et al. | 402/68 |
| 4,882,864 | * | 11/1989 | Selwyn-Smith | 40/359 |
| 5,199,809 | | 4/1993 | Semerjian | 402/4 |
| 5,393,154 | | 2/1995 | Hubbell | 402/4 |
| 5,890,604 | * | 4/1999 | Heinz | 211/46 |

FOREIGN PATENT DOCUMENTS

| | | |
|---|---|---|
| 1417580 | 12/1975 | (GB) . |
| 2235902 | 3/1991 | (GB) . |

OTHER PUBLICATIONS

U.S. Design Application No. 29/075,321, filed Aug. 28, 1997, entitled "Hanging Data Binder."

* cited by examiner

*Primary Examiner*—Andrea Wellington
*Assistant Examiner*—Monica S. Carter
(74) *Attorney, Agent, or Firm*—Pennie & Edmonds LLP

(57) ABSTRACT

A hanging data binder is provided for a stack of paper. The stack of paper is contained between two end pieces that secure the flexible posts passing through the stack. The end pieces include retractable hooks that serve to secure the flexible posts and provide hooks for the hanging data binder. The retractable hooks are slid outwardly to release the flexible posts and inwardly to store the hooks.

14 Claims, 6 Drawing Sheets

HANGING DATA BINDER

This application claims the benefit of Provisional No. 60/056,256 filed Aug. 29, 1997.

BACKGROUND OF THE INVENTION

Hanging file systems are a convenient way to store binders or other stacks of paper. Although a single rail can be used, typical hanging file systems employ two rails in parallel. The rails are spaced apart a sufficient distance to allow the entire stack of paper or binder to fit inside the rails. In order for the stacks of paper or binder to hang from the rails, hooks are attached to the binder along its bound edge. These hooks extend beyond the edges of the binder and as such contact or rest on the rails.

When the binder is removed from the rails of the hanging file system, the hooks from which the binder is suspended can interfere with the use of the binder by snagging furniture, clothing, other binders, etc. In addition, the user of the binder risks snapping off the hook, thus destroying the binder.

Attempts to solve the shortcomings of fixed hook binders include removable hooks such as those disclosed in U.S. Pat. No. 5,393,154, and retractable hooks such as those disclosed in U.S. Pat. Nos. 3,865,445, 4,445,799, 4,288,170, and 5,199,809. These retractable hooks all retract within the edges of the binder; however, the hooks are independent of the actual binding mechanism of the binder, creating the need for a completely independent binding mechanism or a generally more complicated retracting and binding mechanism.

U.S. Pat. No. 3,957,321 discloses a simple binder mechanism for binding stacks of paper such as reports or computer printouts. The stack of paper is sandwiched between two support pieces and a pair of rods are passed through one support piece, the stack of papers, and the second support piece. The rods are then bent inward against the support pieces. Hook pieces slideably attached to the support pieces that previously had been slid inward to allow passage of the rods are then slid outward over the bent ends of the rods. This anchors the rods, binding the stack of paper. The hook pieces can be further slid outward, extending the hooks beyond the edge of the stack of papers for engaging the rails of the hanging file system.

Although the hook pieces serve the dual purpose of providing hooks for the hanging file system and binding the stack of papers together, the hooks pieces are not securable in any position and are always free to slide in or out. The hook pieces are slid outward to engage the rods, and therefore the end of the rods must be held against the support piece and carefully threaded under the hook piece. In order to cover any extra length of rod, a separate cover must be attached to the stack of papers. Further, even with a cover, the free ends of the rods can fall out of off of the support piece and become snagged or interfere with the pages of the stack of papers.

The present invention overcomes the limitations of the prior art by providing a hanging data binder capable of binding and hanging a stack of papers.

SUMMARY OF THE INVENTION

A hanging data binder is provided for use in a hanging file type system. Flexible posts are passed through the stack of paper and secure on either side by end pieces. The end pieces include retractable hooks for suspending the hanging data binder in the hanging file system and secure the flexible posts in the end pieces.

The retractable hooks are slidable among a closed position, a hook position, and a release position. The release position allows the flexible posts to be inserted into the end pieces, the hook position secures the flexible posts and exposes curved portions for engaging the hanging file system, and the closed position also secures the flexible posts and retracts the curved portion within the end piece. In moving from the closed through the hook and to the release position, the retractable hooks are slid outwardly. tabs engaging recesses secure the retractable hook in the selected position.

The hanging data binder may also include a hinged cover for the end piece to cover and protect the flexible posts and retractable hooks, front and back covers, a foldable handle, and a spine label.

IN THE DRAWINGS

DESCRIPTION OF THE PREFERRED EMBODIMENTS

Figure 1:
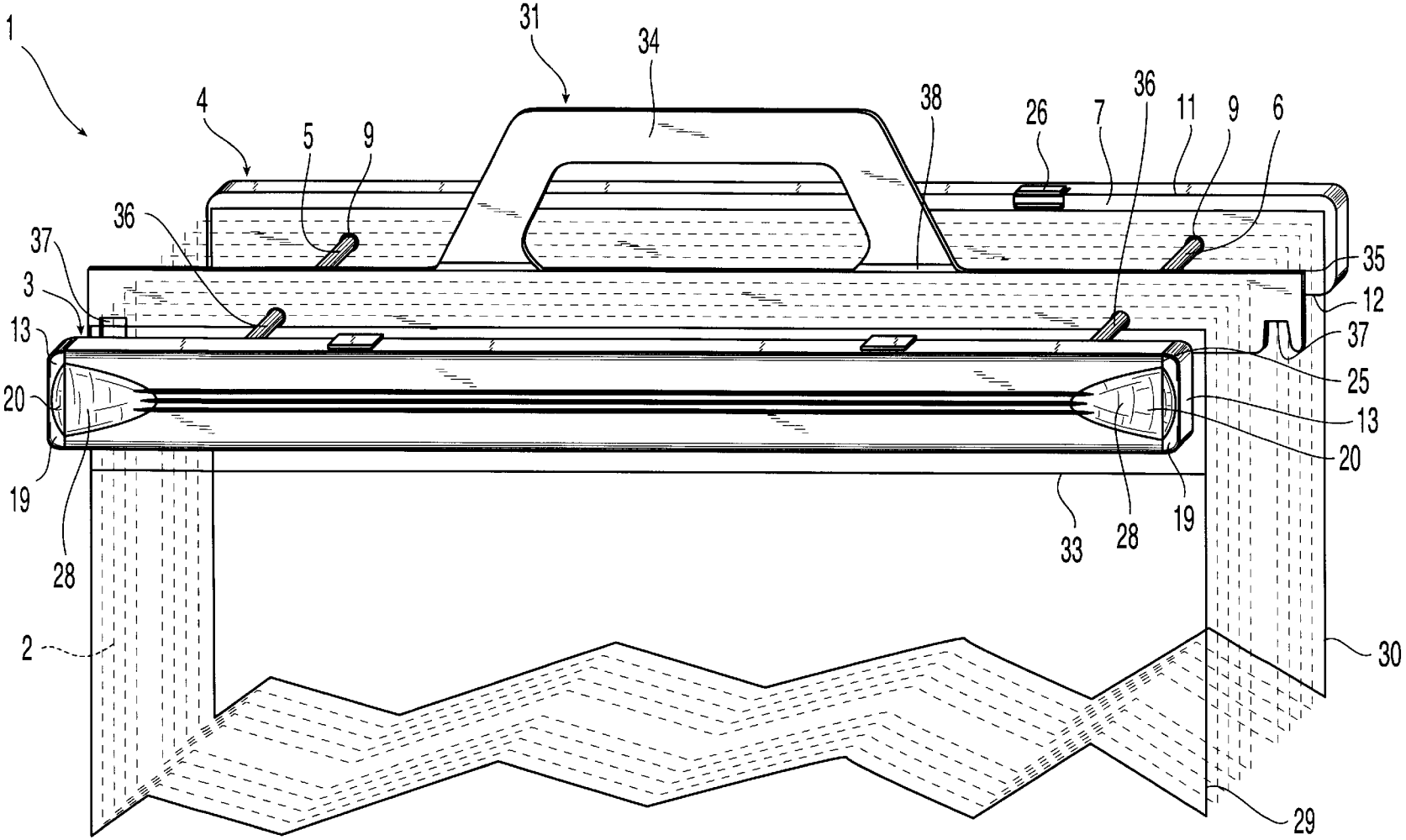
FIG. 1 is a perspective view of a hanging data binder according to the present invention.

Referring to FIG. 1, the present invention is directed to a hanging data binder 1 capable of holding a stack of paper 2 containing varying numbers of sheets of paper. The stack of paper 2 is bound together by two end piece bodies 3,4, removably connected to one another by a plurality of flexible posts. In a preferred embodiment, the hanging data binder includes a pair of flexible posts 5,6. The flexible posts 5,6 may be made of any suitable flexible material such as metal or plastic that resists corrosion, can sustain repeated flexing, and facilitates passage of the posts through the stack of paper 2 and the end pieces 5,6. Preferably the flexible posts 5,6 are polycoated steel posts, commercially available under the name DATAFLEX®, or nylon posts.

Figure 9:
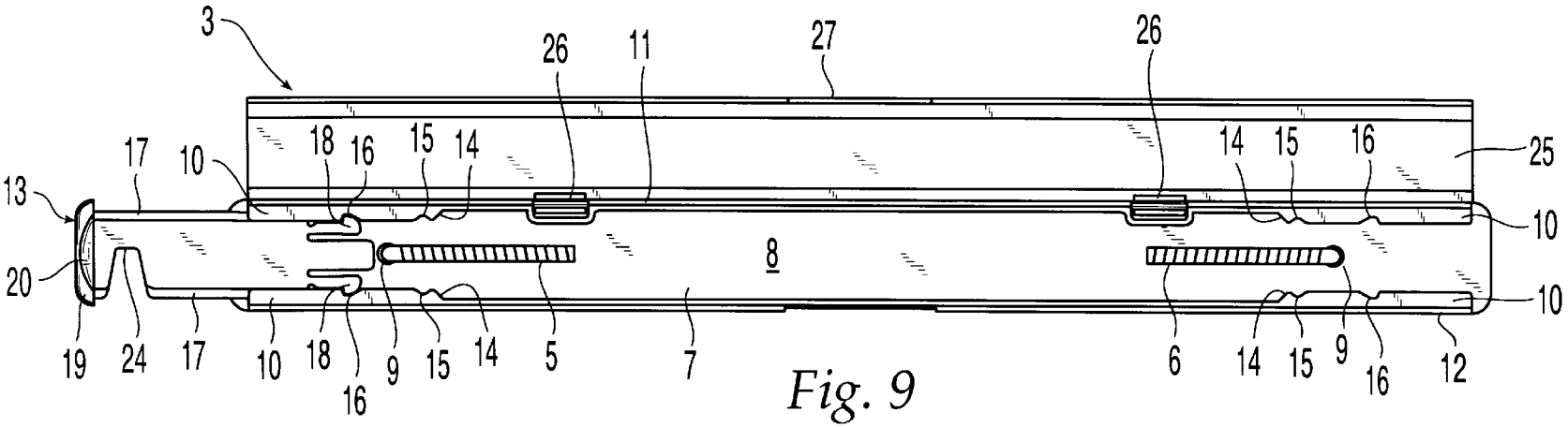
FIG. 9 is a front view of the end piece of the hanging data binder in a release position with the cover member open.

Referring to FIGS. 2–9, the end pieces 3,4 are shown in greater detail. Since the end pieces 3,4 are identical, reference is made to only one, but the following description applies to both. The end piece 3 is constructed to accept and to secure one end of each of the flexible posts 5,6. To do this the end piece includes a base member 7 having a channel 8 and a pair of holes 9 in post receiving portions. The holes 9 are dimensioned to permit the flexible posts 5,6 to pass through the base member 7. When the flexible posts 5,6 are passed through the holes 9 the excess lengths of posts are stored in the channel 8 as is best shown in FIG. 9.

The end piece 3 includes a mechanism for attaching the hanging data binder 1 to the supports of a hanging file system. The mechanism is retractable, removable, and can accommodate at least the size of the paper held on the posts 5,6 of the binder 1. The mechanism can also serve to secure the flexible posts 5,6 in the channel 8.

Figure 4:
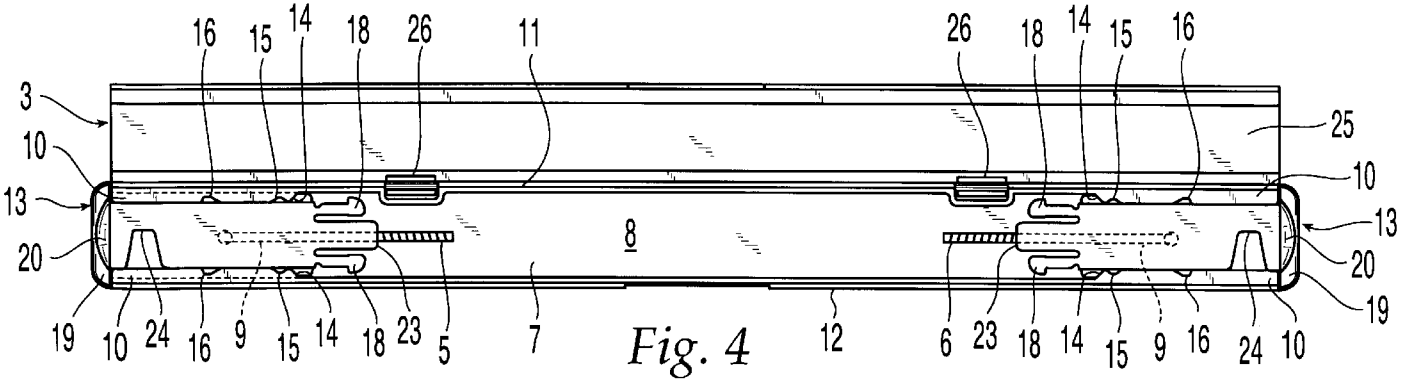
FIG. 4 is a front view of the end piece of the hanging data binder with the cover member open.
Figure 5:
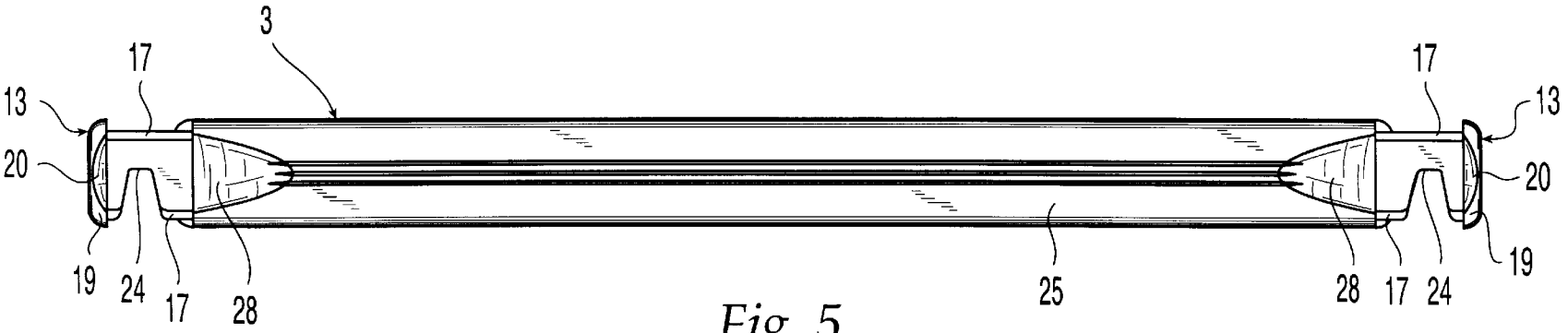
FIG. 5 is a front view of the end piece of the hanging data binder in a hook position.
Figure 6:
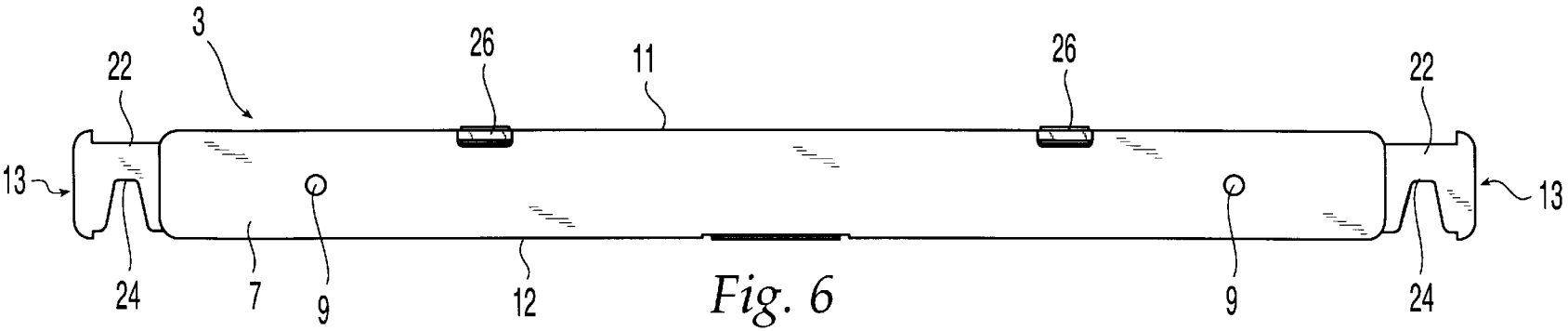
FIG. 6 is a back view of the end piece of the hanging data binder in the hook position.
Figure 7:
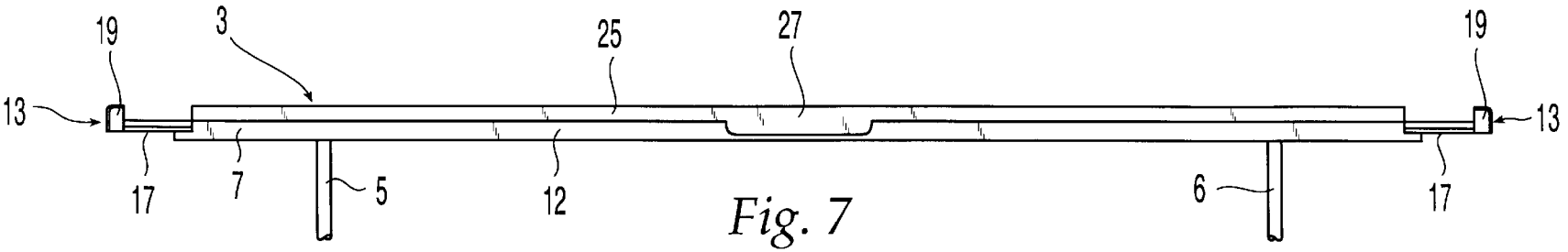
FIG. 7 is a bottom view of the end piece of the hanging data binder in the hook position.
Figure 8:
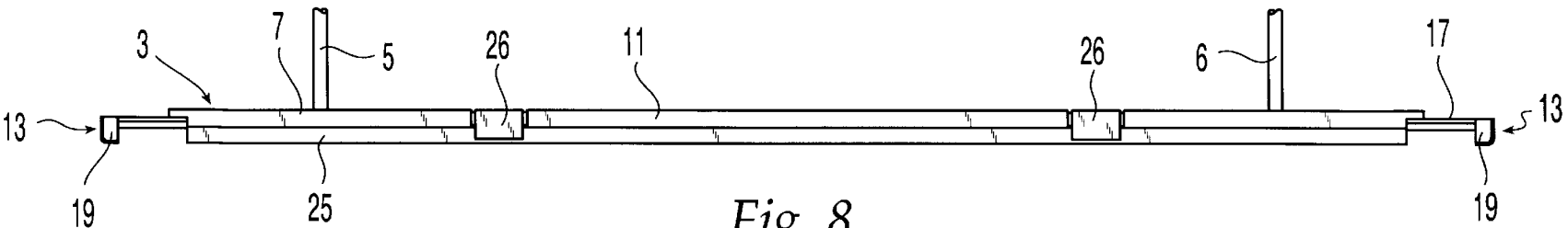
FIG. 8 is a top view of the end piece of the hanging data binder in the hook position.

Preferably, the mechanism includes tracks 10 extending over the channel 8 along both a top edge 11 and a bottom edge 12 at either end of the base member 7 and two retractable hooks 13 slidingly engaged in the tracks 10, as is best shown in FIGS. 4 and 9.

The tracks 10 extend from both ends of the base member 7 toward the middle or inwardly of the base member 7 but do not completely extend along either the top or bottom edge. Therefore, the tracks 10 terminate at an inner edge 14. In addition, the tracks 10 include a plurality of recesses. Preferably, the tracks include two recesses, a hook position recess 15 and a release position recess 16.

The retractable hooks 13 are multi-positionable dual-function members. The retractable hooks 13 are slideably engaged in the channel 8 at either end of the base member 7. Preferably, the retractable hooks 13 can be slideably positioned and secured among three positions, a retracted closed position, FIGS. 1–4, an extended hook position, FIGS. 5–8, and a further extended release position, FIG. 9. The release position is located outwardly from the hook position along the channel 8 in the direction of the ends of the base member 7, and the hook position is located outwardly from said closed position along the channel 8 in the direction of the ends of the base member 7. The retractable hooks 13 extend along the channel 8 as far as the location of the holes 9 in at least one position.

Figure 10:
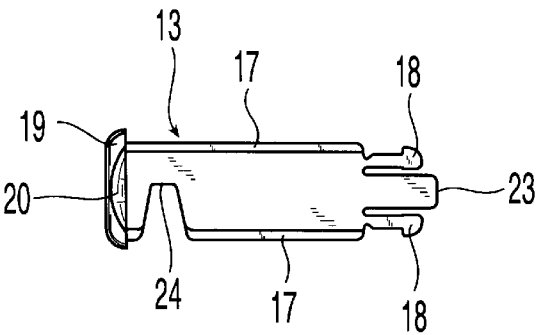
FIG. 10 is a front view of a retractable hook of the hanging data binder.

In order to provide slideability and securability, the retractable hooks 13 include structure complementary to the structure of the base member 7. Referring to FIG. 10, the retractable hooks 13 include rails 17 running along either edge for engaging the tracks 10 and flexible tabs 18 for engaging the recesses in the tracks 10. As can be seen for instance in FIG. 8, the rails 13 are typically thinner than the body of the retractable hooks 13.

The retractable hooks 13 include a head 19 dimensioned to integrate with the overall shape of the end piece 3 especially when the retractable hooks 13 are in the retracted position. The head 19 further includes an indentation 20 to provide a gripping surface for assisting in the sliding of the retractable hooks 13.

Figure 11:
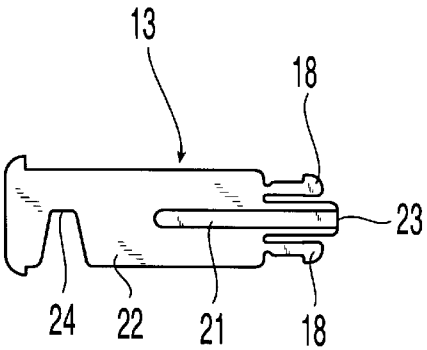
FIG. 11 is a back view of another retractable hook of the hanging data binder.

As shown in FIG. 11, each retractable hook 13 includes a notch 21 running along a retaining portion or backside 22 of the retractable hook 13. The notch 21 opens along an interior end 23 of the retractable hook 13 opposite the head 19 and is dimensioned to accept the flexible posts 5,6.

Finally, the retractable hooks 13 include curved mounting portions 24 that are concave and open downward along an edge of the retractable hooks 13 corresponding to the bottom edge of the base member 7. The curved portions 24 are dimensioned to accept the supports of a hanging file support system and are exposed and accessible when the retractable hooks 13 are in either the hook or release positions. The curved portions 24 are properly spaced to accept the supports in at least the hook position.

Therefore in the preferred embodiment, the retractable hooks 13 serve the dual functions of securing the flexible posts 5,6 in the channel 8 and providing the hooks for the hanging data binder 1. This dual functionality is described below with reference to the assembly of the hanging data binder 1.

In order to assemble the hanging data binder 1, the retractable hooks 13, having been placed in the base member 7 by inserting the rails 17 in the tracks 10, are extended out from the middle of the base member 7 to the extended release position such that the holes 9 are exposed and the flexible tabs 18 are engaged in the release position recesses 16 as is best seen in FIG. 9. The flexible posts 5,6 are inserted through a stack of paper 2 and through the holes 9 in the base members 7 of the end pieces 3,4. Once inserted through the holes 9, the flexible posts 5,6 are folded over at an angle of about 90° as they exit the holes 9. Bending over of the flexible posts 5,6 can be accomplished by hand or by sliding the retractable hooks 13 toward the middle of the base member 7. In either case, the notch 21 will engage the flexible posts 5,6, securing them in the channel 8. Unlike previous hanging binders, the notch 21 is aligned with the hole 9 and engages the flexible posts 5,6 from the bent end, alleviating the need to thread a free end of the flexible posts 5,6 under the retractable hooks 13. In addition, as the retractable hooks 13 are further pushed toward the middle of the base member 7, additional lengths of flexible posts 5,6 are secured as opposed to exposing the flexible post as in prior art hanging binders.

As the retractable hooks are further pushed toward the middle of the base member 7, the flexible tabs 18 will next engage the hook position recesses 16. The retractable hooks 13 are now in the extended hook position as shown in FIGS. 5–8. In this position, the flexible posts 5,6 are still secured in the channel 8, and the curved portions 24 are exposed permitting the hanging data binder 1 to be used in a hanging file system.

When the hanging data binder 1 is removed from the hanging file system, the curved portions 24 can be retracted and protected by pushing the retractable hooks 13 further toward the middle of the base member 7 until the flexible tabs 18 engage the inner edges 14 of the tracks 10. The retractable hooks 13 are now in the retracted closed position where the flexible posts 5,6 continue to be secured in the channel 8 and the head 19 is flush with the end piece 3,4 as is best shown in FIG. 4. The hanging data binder 1 of the present invention can be opened for accepting additional sheets by extending the retractable hooks 13 outwardly to the release position.

The length of the end pieces 3,4 can be expanded or reduced in alternate embodiments, along with the retractable hooks 13, to accommodate many different widths or lengths of paper, depending upon their orientations (i.e., 8.5×11 or 8.5×14 inches). It is also possible to have four positions for the retractable hooks 13, for example, a closed position, a letter size hook position, a legal size hook position, and a release position.

Figure 2:
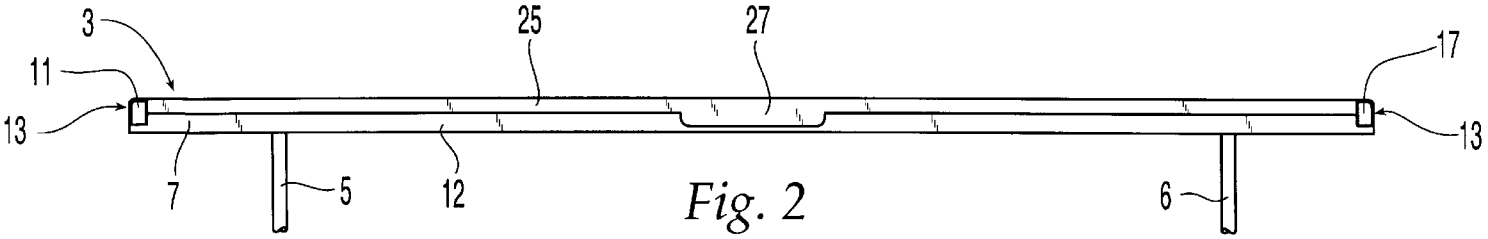
FIG. 2 is a bottom view of an end piece of the hanging data binder.
Figure 3:
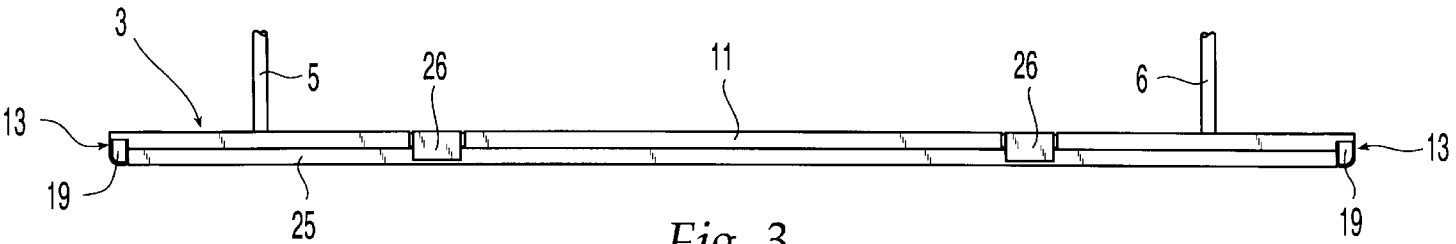
FIG. 3 is a top view of the end piece.

In a preferred embodiment, the end pieces 3,4 include a cover member 25. The cover member 25 is hingedly attached to the base member 7 along the top edge 11 and serves to hide the retractable hooks 13 when in the closed position and the excess lengths of flexible posts 5,6 as shown in FIGS. 1–3. The cover member 25 is rotated away from the base member 7 to an open position to allow access to the flexible posts 5,6 as shown in FIG. 4. Although any hinge mechanism may be used, in the preferred embodiment, a removable hinge-type arrangement 26 is provided at the top edge 11. In this embodiment, the cover member 25 includes a latch 27 for engaging the bottom edge 12 of the base member 7. Alternatively, a living hinge or scored hinge can be used. Additionally, the cover member 25 includes depressions 28 on either end to facilitate easy extension of the retractable hooks 13.

The end piece 3 and cover member 25 are constructed of any suitable material providing the mix of rigidity and flexibility. Suitable materials include plastics or metals. In a preferred embodiment, the end piece 3 and cover member 25 are made from ABS material.

The hanging data binder optionally includes a front cover 29 and a back cover 30, a foldable handle 31, and a spine label 32.

As shown in FIG. 1, the front and back covers 29, 30, are positioned between the end pieces 3,4 and the stack of paper 2. The front and back covers include the necessary structure to accommodate the passage of the flexible hooks through the front and back covers and preferably at least one score 33 parallel to the end pieces 3,4 to permit the cover to be bent, exposing the stack of paper 2. The covers can be genuine press board, commercially available under the trade name PRESSTEX®, TextGuard, Type I Pressboard, Genuine Press Board, and Recycled Genuine Press Board. Additionally, linen press board, vinyl, and polyethylene sheets, commercially available under the name ACCOHIDE®, can also be used.

Figure 13:
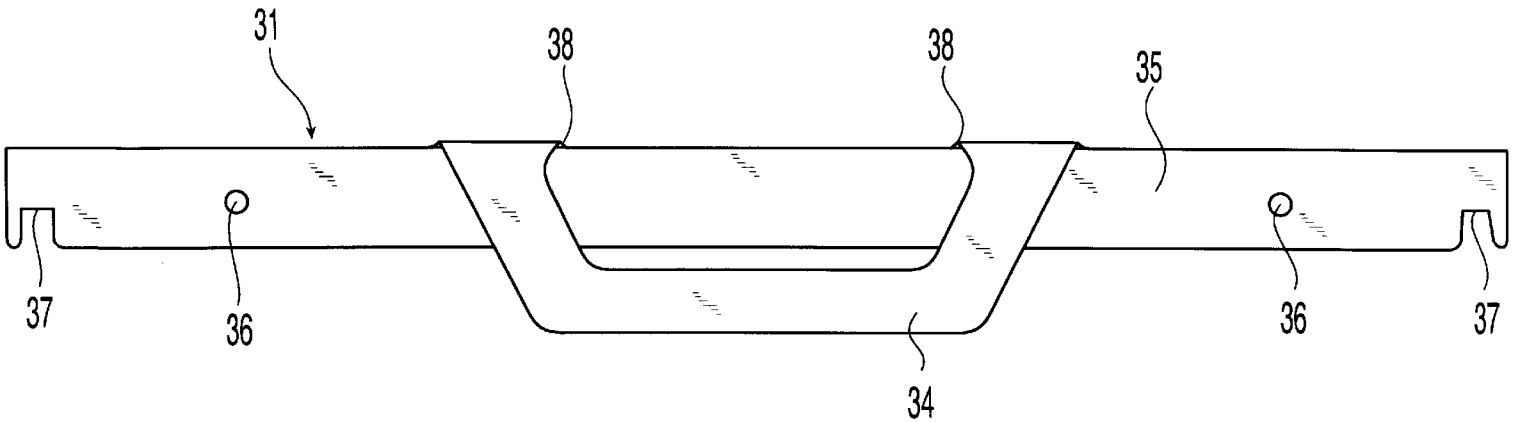
FIG. 13 is a front view of a handle member of the hanging data binder with a handle in a folded position.

Now referring to FIGS. 1 and 13, a foldable carrying handle 31 is included between the end pieces 3,4. The foldable handle 31 includes a top arcuate portion 34 attached to an elongated bottom portion 35. Passages 36 in the elongated bottom portion 35 are provided for accepting the flexible posts 5,6. The foldable handle may optionally include cut-outs 37 adjacent either end of the elongated bottom portion 35 to engage the rails in a hanging file system. As best shown in FIG. 13, the handle 31 can also be folded over at the intersection 38 of the arcuate top portion 34 and the elongated bottom portion 35 to allow, for example, a file drawer to be closed when the hanging data binder 1 is resting on the file drawer rails. The handle 31 may be either injection molded or stamped from a sheet of polystyrene, or other similar plastic material. If the handle 31 is injection-molded, then the location where the arcuate handle portion 34 folds over at the elongated portion 35 is made as a living hinge. If stamped from polystyrene, then the handle 31 is scored at that intersection 38 to allow the handle 31 to fold over and out of the way for storage purposes.

Figure 12:
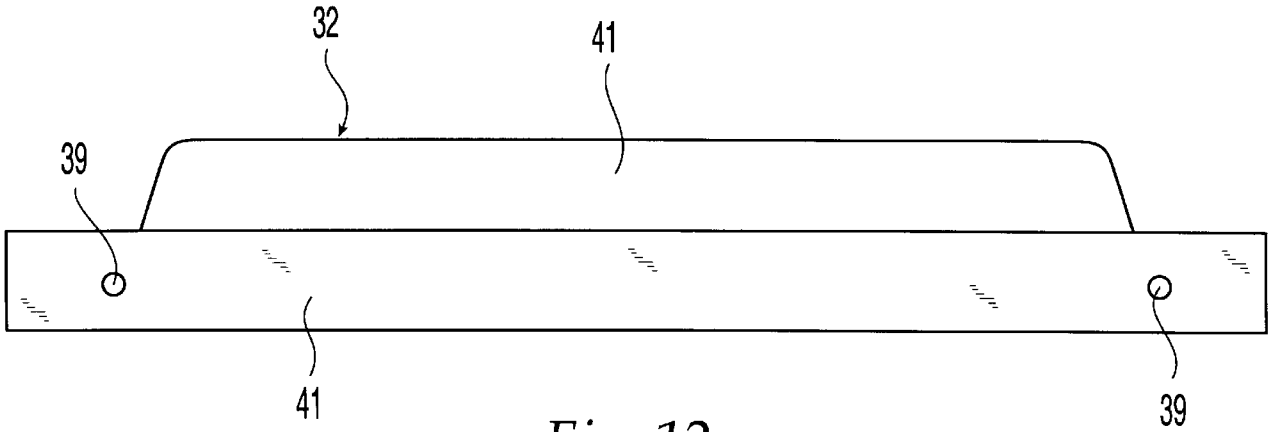
FIG. 12 is a front view of a spine label of the hanging data binder.

A spine label 32 may be inserted into the hanging data binder 1 between the end pieces 3,4 to identify the contents of the binder. A suitable spine label 32 is shown in FIG. 12. The spine label 32 is typically made out of a plastic material such as nylon. The spine label 32 is attached to the hanging data binder 1 by passing the flexible posts 5,6 through the openings 39 in the bottom portion 40. The bottom portion 40 is dimensioned to be contained within the hanging data binder so as not to interfere with the hooks or stack of paper. A top portion 41, however, extends beyond the edges of the hanging data binder 1 and can accept paper labels or other indicators of the contents of the hanging data binder 1.

One of ordinary skill in the art can envision numerous variations and modifications. All of these modifications are contemplated by the true spirit and scope of the following claims.

What is claimed is:

1. A hanging data binder for binding a stack of paper comprising:

(a) a post configured for supporting papers thereon;

(b) an end piece including a body with a post receiving portion dimensioned to receive the post with the body defining a hook position recess; and (c) a movable portion movably mounted to the body and including a flexible tab and mounting portion for mounting to a hanging file support, the movable portion being selectively positionable in:

(i) a first hook position in which the movable portion secures the post relative to the body and the mounting portion is extended to engage the hanging file support, and (ii) a release position with the mounting portion disposed outwardly from the hook position in relation to the body, for releasing the post relative to the body;

wherein the flexible tab of the movable portion is configured for engaging the hook position recess when in the hook position such that the hook position recess locates the movable portion in the hook position, and the body defines a release position notch engaging the tab in the release position for locating the movable portion in the release position.

2. The hanging data binder of claim 1, wherein the movable portion is selectively positionable in a closed position for securing the post relative to the body and in which the mounting portion is retracted inwardly from the hook position relative to the body.

3. The hanging data binder of claim 2, wherein the mounting portion is substantially enclosed within the body in the closed position.

4. The hanging data binder of claim 1, wherein the body includes:

(a) a base member;

(b) a cover member movably attached to the base member for movement between an open position and a closed position, the post being disposed between the cover and base members when in the open position, wherein the movable portion is movable with respect to the cover member; and (c) a latch member associated with the cover and the base members for securing the cover and base members in the closed position.

5. The hanging data binder of claim 4 wherein the cover member is separable from the base member.

6. The hanging data binder of claim 1, further comprising a foldable handle member including:

(a) a bottom handle portion defining passages configured to receive the post; and (b) a handle pivotably attached to the bottom portion for folding thereagainst.

7. The hanging data binder of claim 1, wherein the mounting portion comprises a hook for engaging rails in a hanging type file system.

8. The hanging data binder of claim 1, wherein the movable member is configured for guiding the post inwardly and away from the mounting member when the movable member is moved from the release position to the hook position.

9. A hanging data binder for binding a stack of paper comprising:

(a) first and second posts configured for supporting papers thereon;

(b) an end piece including a body with a post receiving portion dimensioned to receive the posts with the body defining first and second hook position recesses; and, (c) first and second movable portions movably mounted to the body, each of the movable portions including a flexible tab and mounting portion for mounting to a hanging file support, the movable portions being selectively positionable in:

(i) a hook position in which the first and second movable portion respectively fix the first and second posts relative to the body and the mounting portions are extended to engage the hanging file support, and (ii) a release position with the mounting portions disposed further from each other than in the hook positions for releasing the post relative to the body;

wherein the flexible tab of each of the movable portions respectively is configured for engaging the first and second hook position recesses when in the hook position such that each hook position recess locates one of the movable portions in the hook position, and the body defines first and second release position notches enraging the tabs in the release position for locating each of the movable portions in the release position.

10. The hanging data binder of claim 9, wherein the movable members are configured for guiding the posts towards each other when the movable members are moved from the release position to the hook position.

11. The binder of claim 1, wherein the movable portion is selectively positionable in a second hook position in which the movable portion secures the post relative to the body and the mounting portion is extended further than in the first hook position to engage the hanging file support.

12. The binder of claim 1, wherein the movable portion is securable with respect to the end piece in the first hook position.

13. A hanging data binder for binding a stack of paper comprising:

(a) a post configured for supporting papers thereon;

(b) an end piece including a body with a post receiving portion dimensioned to receive the post with the body defining a hook position recess; and (c) a movable portion movably mounted to the body and including a flexible tab and mounting portion for mounting to a hanging file support, the movable portion being selectively positionable in:

(i) a first hook position in which the movable portion secures the post relative to the body and the mounting portion is extended to engage the hanging file support, and (ii) a release position with the mounting portion disposed outwardly from the hook position in relation to the body, for releasing the post relative to the body;

wherein the flexible tab of the movable portion is configured for engaging the hook position recess when in the hook position such that the hook position recess locates the movable portion in the hook position, and the movable portion defines a notch facing the post receiving portion and configured to locate and direct the post against the body in an inward direction.

14. A hanging data binder for binding a stack of paper comprising:

(a) first and second posts configured for supporting papers thereon;

(b) an end piece including a body with a post receiving portion dimensioned to receive the posts with the body defining first and second hook position recesses; and, (c) first and second movable portions movably mounted to the body, each of the movable portions including a flexible tab and mounting portion for mounting to a hanging file support, the movable portions being selectively positionable in:

(i) a hook position in which the first and second movable portion respectively fix the first and second posts relative to the body and the mounting portions are extended to engage the hanging file support, and (ii) a release position with the mounting portions disposed further from each other than in the hook positions for releasing the post relative to the body;

wherein the flexible tab of each of the movable portions respectively is configured for engaging the first and second hook position recesses when in the hook position such that each hook position recess locates one of the movable portions in the hook position, and each of the movable portions defines a notch facing the post receiving portion and configured to locate and direct the post against the body in an inward direction.

* * * * *